US008123346B2

(12) United States Patent
Ohnishi et al.

(10) Patent No.: US 8,123,346 B2
(45) Date of Patent: Feb. 28, 2012

(54) ULTRAVIOLET CURING INKJET PRINTER, PRINTING METHOD USED IN ULTRAVIOLET CURING INKJET PRINTER, AND HEAD

(75) Inventors: Masaru Ohnishi, Tomi (JP); Hironori Hashizume, Tomi (JP); Yuko Hishida, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 342 days.

(21) Appl. No.: 12/392,963

(22) Filed: Feb. 25, 2009

(65) Prior Publication Data

US 2009/0244230 A1 Oct. 1, 2009

(30) Foreign Application Priority Data

Feb. 29, 2008 (JP) ..... 2008-050390

(51) Int. Cl.
*B41J 2/01* (2006.01)

(52) U.S. Cl. ..... 347/102; 347/101

(58) Field of Classification Search ..... 347/102, 347/14, 16, 19, 101
See application file for complete search history.

(56) References Cited

U.S. PATENT DOCUMENTS

| | | | | |
|---|---|---|---|---|
| 7,137,696 | B2 * | 11/2006 | Siegel | 347/102 |
| 7,152,969 | B2 * | 12/2006 | Hintermann | 347/102 |
| 7,178,913 | B2 * | 2/2007 | Kumamoto et al. | 347/102 |
| 7,837,319 | B2 * | 11/2010 | Rodin et al. | 347/102 |
| 2001/0038408 | A1 * | 11/2001 | Codos et al. | 347/102 |
| 2002/0191063 | A1 * | 12/2002 | Gelbart et al. | 347/101 |
| 2003/0179270 | A1 * | 9/2003 | Yamamoto et al. | 347/102 |
| 2003/0227527 | A1 * | 12/2003 | Richards | 347/102 |
| 2005/0168555 | A1 * | 8/2005 | Niekawa | 347/102 |
| 2006/0038868 | A1 * | 2/2006 | Otter | 347/102 |
| 2006/0227194 | A1 * | 10/2006 | Hoshino | 347/102 |
| 2006/0230969 | A1 * | 10/2006 | Vosahlo | 101/488 |
| 2006/0238592 | A1 * | 10/2006 | Kadomatsu et al. | 347/102 |
| 2008/0079795 | A1 * | 4/2008 | Nakazawa | 347/102 |
| 2008/0174649 | A1 * | 7/2008 | Nakano et al. | 347/102 |
| 2008/0231679 | A1 * | 9/2008 | Nakhmanovich et al. | 347/101 |
| 2009/0086000 | A1 * | 4/2009 | Yokota | 347/102 |

FOREIGN PATENT DOCUMENTS

| | | |
|---|---|---|
| JP | 2007-050555 | 3/2007 |

* cited by examiner

*Primary Examiner* — Stephen Meier
*Assistant Examiner* — Leonard S Liang
(74) *Attorney, Agent, or Firm* — Ditthavong Mori & Steiner, P.C.

(57) ABSTRACT

An ultraviolet curing inkjet printer includes a first ejecting device, a first ultraviolet light irradiation device, and a second ultraviolet light irradiation device. The first ultraviolet light irradiation device is configured to emit ultraviolet light of a first light quantity for temporarily curing the ultraviolet curable inks ejected from the first ejecting device. The first ultraviolet light irradiation device is disposed posterior to the first ejecting device in a first direction as a scanning direction. The second ultraviolet light irradiation device is configured to emit ultraviolet light of a second light quantity for finally curing the ultraviolet curable inks temporarily cured by the first ultraviolet light irradiation device. The second ultraviolet light irradiation device is disposed anterior to the first ejecting device in a second direction, which is perpendicular to the first direction and is a moving direction of a recording medium relative to the first ejecting device.

8 Claims, 13 Drawing Sheets

ULTRAVIOLET CURING INKJET PRINTER, PRINTING METHOD USED IN ULTRAVIOLET CURING INKJET PRINTER, AND HEAD

CROSS-REFERENCE TO RELATED APPLICATION

The present application claims priority under 35 U.S.C. §119 to Japanese Patent Application No. 2008-050390, filed on Feb. 29, 2008, the entire contents of which are herein incorporated by reference.

BACKGROUND OF THE INVENTION

1. Field of the Invention

The present invention relates to an ultraviolet curing inkjet printer in which a head ejecting ultraviolet curable ink scans a plurality of times for each single line on a recording medium, a printing method used in the ultraviolet curing inkjet printer, and a head.

2. Discussion of the Background

Conventionally, in case of printing on a transparent medium (recording medium) such as a polycarbonate film by an ultraviolet curing inkjet printer, a backing process is conducted. That is, after a color image are printed with color ultraviolet curable inks (UV ink: Ultraviolet ink) to form an image layer on the medium, a white UV ink is superposed on an upper layer (surface) of the color image to form a ground color layer in order to show the color printed image vibrantly. Therefore, the head of the conventional UV inkjet printer is provided with an imaging inkjet head and a backing inkjet head which is disposed anterior to the imaging inkjet head in the feeding direction (for example, see JP-A-2007-050555). The head is further provided with ultraviolet emitting devices for emitting ultraviolet light, which are disposed posterior to the imaging inkjet head and the backing inkjet head in the scanning direction, respectively. The contents of JP-A-2007-050555 are herein incorporated by reference in their entirety.

UV inks are ejected from the imaging inkjet head and ultraviolet light is emitted from a UVLED while the head is moved in the scanning direction, a color image is printed. Then, after the medium is moved in the feeding direction, the head is moved in the scanning direction again, a white UV ink is ejected from the backing inkjet head, and ultraviolet light is emitted from a UVLED, thereby backing the color image with the white UV ink.

For the purpose of improving the print quality, there has been devised a multipass printing method in which UV inks are superposed by scanning a plurality of times for each single line. However, the conventional ultraviolet curing inkjet printer has a problem that UV ink is finally cured at every scanning so that the UV inFk on the upper layer side (outer side) is liable to be stripped because it is rejected by the UV ink on the lower layer side (media side).

SUMMARY OF THE INVENTION

According to one aspect of the present invention, an ultraviolet curing inkjet printer includes a first ejecting device, a first ultraviolet light irradiation device, and a second ultraviolet light irradiation device. The first ejecting device is configured to eject ultraviolet curable inks to a plurality of lines on the recording medium. The first ultraviolet light irradiation device is configured to emit ultraviolet light of a first light quantity for temporarily curing the ultraviolet curable inks ejected from the first ejecting device. The first ultraviolet light irradiation device is disposed posterior to the first ejecting device in a first direction as a scanning direction. The second ultraviolet light irradiation device is configured to emit ultraviolet light of a second light quantity for finally curing the ultraviolet curable inks temporarily cured by the first ultraviolet light irradiation device. The second ultraviolet light irradiation device is disposed anterior to the first ejecting device in a second direction, which is perpendicular to the first direction and is a moving direction of the recording medium relative to the first ejecting device.

According to another aspect of the present invention, a printing method for an ultraviolet curing inkjet printer includes a first ejecting step of ejecting ultraviolet curable inks to a plurality of lines on the recording medium. In a first ultraviolet light irradiation step, ultraviolet light of a first light quantity is emitted for temporarily curing the ultraviolet curable inks ejected in the first ejecting step. In a second ultraviolet light irradiation step, ultraviolet light of a second light quantity is emitted for finally curing the ultraviolet curable inks temporarily cured in the first ultraviolet light irradiation step after all scans for a same line by the first ejecting step are completed.

According to further aspect of the present invention, a head used in an ultraviolet curing inkjet printer includes a first ejecting device, a first ultraviolet light irradiation device, and a second ultraviolet light irradiation device. The first ejecting device is configured to eject ultraviolet curable inks to a plurality of lines on the recording medium. The first ultraviolet light irradiation device is configured to emit ultraviolet light of a first light quantity for temporarily curing the ultraviolet curable inks ejected from the first ejecting device. The first ultraviolet light irradiation device is disposed posterior to the first ejecting device in a first direction as a scanning direction. The second ultraviolet light irradiation device is configured to emit ultraviolet light of a second light quantity for finally curing the ultraviolet curable inks temporarily cured by the first ultraviolet light irradiation device. The second ultraviolet light irradiation device is disposed anterior to the first ejecting device in a second direction, which is perpendicular to the first direction and is a moving direction of the recording medium relative to the head.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIGS. 10A and 10B are illustrations showing laminated structures of UV inks, wherein FIG. 10A shows a laminated structure of UV inks in case of being scanned by a conventional ultraviolet curing inkjet printer and FIG. 10B shows a laminated structure of UV inks in case of being scanned by the ultraviolet curing inkjet printer according to this embodiment;

DETAILED DESCRIPTION OF EXEMPLARY EMBODIMENTS OF THE INVENTION

Figure 1:
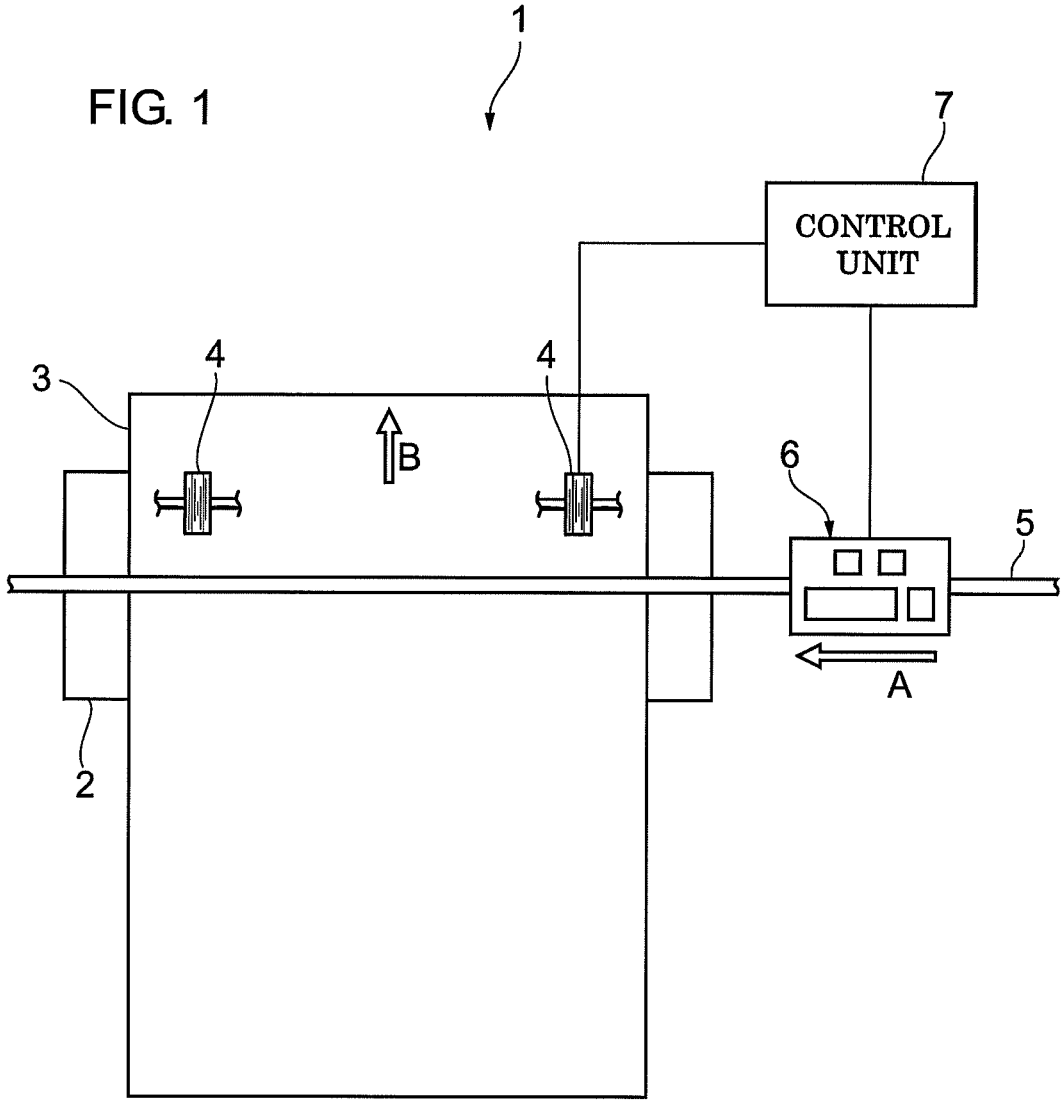
FIG. 1 is a plan view of an ultraviolet curing inkjet printer according to an embodiment.

Embodiments of the present invention will be described hereinafter with reference to the accompanying drawings. In the following description, the constituent elements having substantially the same function and arrangement are denoted by the same reference numerals, and repetitive descriptions will be made only when necessary. The embodiments of the present invention have the following arrangements.

Figure 2:
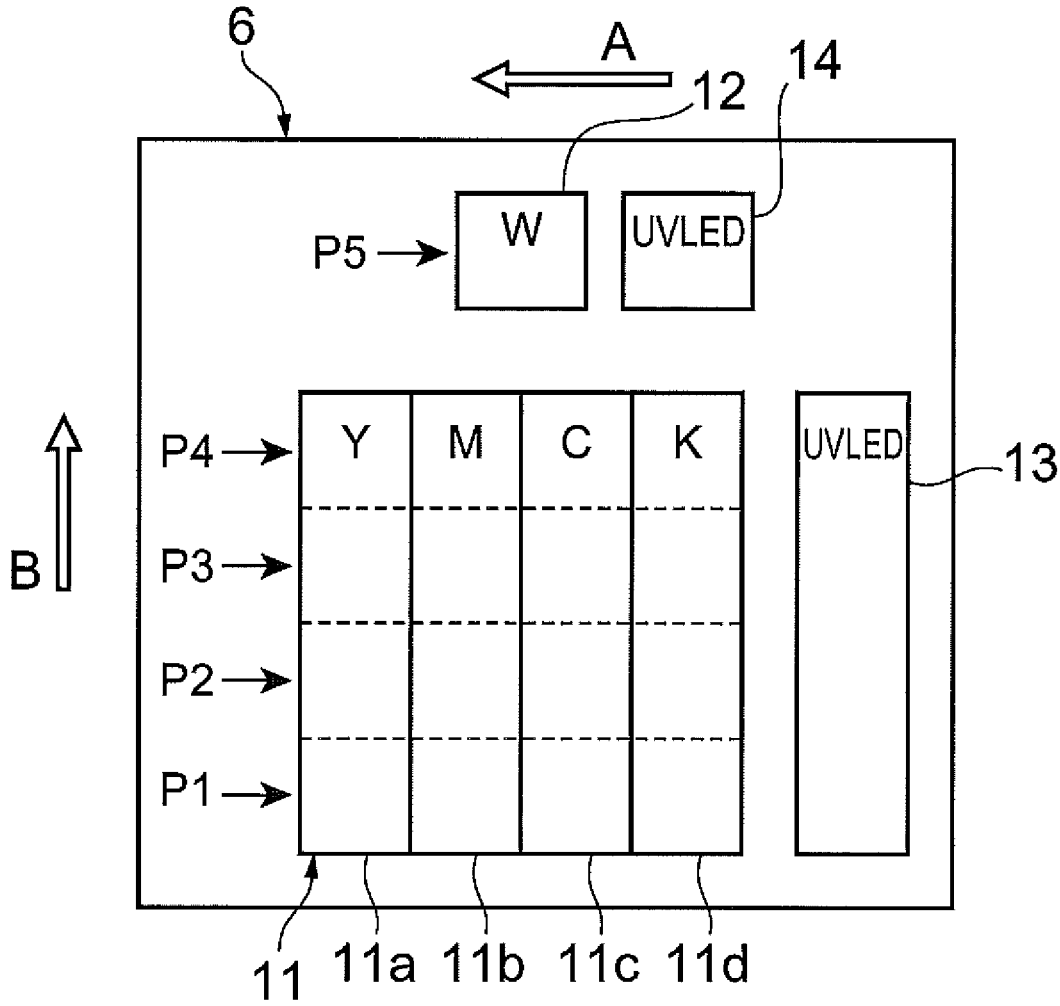
FIG. 2 is an illustration showing the structure of a head in the ultraviolet curing inkjet printer shown in FIG. 1.

FIG. 1 is a plan view of an ultraviolet curing inkjet printer according to an embodiment and FIG. 2 is an illustration showing the structure of a head in the ultraviolet curing inkjet printer shown in FIG. 1. As shown in FIG. 1 and FIG. 2, the ultraviolet curing inkjet printer 1 of this embodiment is an apparatus for printing a color image on a medium 3 composed of a transparent or semi-transparent member such as a polycarbonate film fed on a platen 2. That is, the ultraviolet curing inkjet printer 1 prints a color image with UV inks on the medium 3 and backs (superposes) a white (ground color) UV ink on the color image, thereby showing the color image more vibrantly. The ultraviolet curing inkjet printer 1 is a multi-pass-type printer which feeds the medium 3 in a feeding direction (second direction) B (upward direction in FIG. 1 and FIG. 2) and scans a plurality of times for each single line. Specifically, a color image is printed by four scans (four passes) and is then backed by a single scan (single pass).

The ultraviolet curable inkjet printer 1 is provided with feeding rollers 4 for feeding the medium 3 on the platen 2 in a feeding direction B. The feeding rollers 4 feed the medium 3 at a pitch corresponding to one line in the feeding direction B.

In the ultraviolet curing inkjet printer 1, a guide rail 5 is disposed above the platen 2 (near side in FIG. 1) to extend in a direction perpendicular to the feeding direction B of the medium 3. On the guide rail 5, a head 6 for ejecting UV ink and emitting ultraviolet light are held movably in the extending direction of the guide rail 5.

The head 6 is movable in a scanning direction (first direction) A (leftward direction in FIG. 1 and FIG. 2) and a direction opposite to the scanning direction A (rightward direction in FIG. 1 and FIG. 2) by a driving means (not shown). The movement of the head 6 is achieved, for example, by rotating a driving belt connected to the head 6 by a motor or the like. The rear end (right end in FIG. 1 and FIG. 2) in the scanning direction A of the guide rail 5 is a standby position of the head 6.

The head 6 includes an imaging inkjet head 11, a backing inkjet head 12, a temporary-curing UVLED (Ultra Violet Light Emitting Diode) 13 which emits weak ultraviolet light, and a final-curing UVLED 14 which emits strong ultraviolet light.

The imaging inkjet head 11 eject multicolor UV inks to print a color image on the medium 3. Therefore, the imaging inkjet head 11 is provided with imaging inkjet heads 11*a*-11*d* for ejecting UV inks of yellow Y, magenta M, cyan C, and black K toward the platen 2. Connected to the imaging inkjet heads 11*a*-11*d* are ink tanks (not shown) for storing UV inks of respective colors, respectively. The UV inks of the respective colors are supplied from the ink tanks to the inkjet heads 11*a*-11*d* so that the UV inks of the respective colors are ejected from the inkjet heads 11*a*-11*d*. That is, a UV ink of yellow Y is ejected from the imaging inkjet head 11*a*, a UV ink of magenta M is ejected from the imaging inkjet head 11*b*, a UV ink of cyan C is ejected from the imaging inkjet head 11*c*, and a UV ink of black K is ejected from the imaging inkjet head 11*d*.

The imaging inkjet head 11 prints a color image on the medium 3 by means of four passes. That is, the imaging inkjet head 11 is formed to have a length corresponding to four lines in the feeding direction B. Accordingly, the imaging inkjet head 11 is physically and logically divided in a first-pass region P1, a second-pass region P2, a third-pass region P3, and a fourth-pass region P4 in a direction toward the feeding direction B.

The backing inkjet head 12 ejects a UV ink of white W toward the platen 2 to back the color image printed on the medium 3. For this, the backing inkjet head 12 is disposed anterior to the imaging inkjet head 11 in the feeding direction B and is spaced apart from the imaging inkjet head 11 for a distance corresponding to one line. Connected to the backing inkjet head 12 is an ink tank (not shown) for storing the UV ink of white color. The UV ink of white color is supplied from the ink tank to the backing inkjet head 12 so that the UV ink of white color is ejected from the backing inkjet head 12.

The backing inkjet head 12 prints a ground color layer on the medium 3 by means of one pass. The backing inkjet head 12 is formed to have a length corresponding to one line in the feeding direction B. Since the scan by the backing inkjet head 12 is conducted after the four scans by the imaging inkjet head 11, the backing inkjet head 12 occupies a fifth-pass region.

The temporary-curing UVLED 13 is disposed posterior to the imaging inkjet head 11 in the scanning direction A. As the head 6 is moved in the scanning direction A, the temporary-curing UVLED 13 is moved behind the imaging inkjet head 11 in the moving direction. As the head 6 is moved in the direction opposite to the scanning direction A, the temporary-curing UVLED 13 is moved ahead of the imaging inkjet head 11 in the moving direction. The temporary-curing UVLED 13 emits ultraviolet light to the UV inks, which were ejected from the imaging inkjet head 11 and deposited on the medium 3, in a light quantity required for temporarily curing the UV inks.

The final-curing UVLED 14 is disposed anterior to the imaging inkjet head 11 in the feeding direction B and is disposed posterior to the backing inkjet head 12 in the scanning direction A. As the head 6 is moved in the scanning direction A, the final-curing UVLED 14 is positioned in front of the imaging inkjet head 11 in the feeding direction B and is moved behind the backing inkjet head 12 in the moving direction. As the head 6 is moved in the direction opposite to the scanning direction A, the final-curing UVLED 14 is positioned in front of the imaging inkjet head 11 in the feeding direction B and is moved ahead of the backing inkjet head 12 in the moving direction. The final-curing UVLED 14 emits ultraviolet light to the UV inks, which were ejected from the imaging inkjet head 11 and deposited on the medium 3, and the UV ink, which was ejected from the backing inkjet head 12 and deposited on the medium 3, in a light quantity required for finally curing these UV inks.

The ultraviolet curing inkjet printer 1 is provided with a control unit 7 for controlling the feeding rollers 4, the head 6, the imaging inkjet head 11, the backing inkjet head 12, the temporary-curing UVLED 13 and the final-curing UVLED 14.

Figure 3:
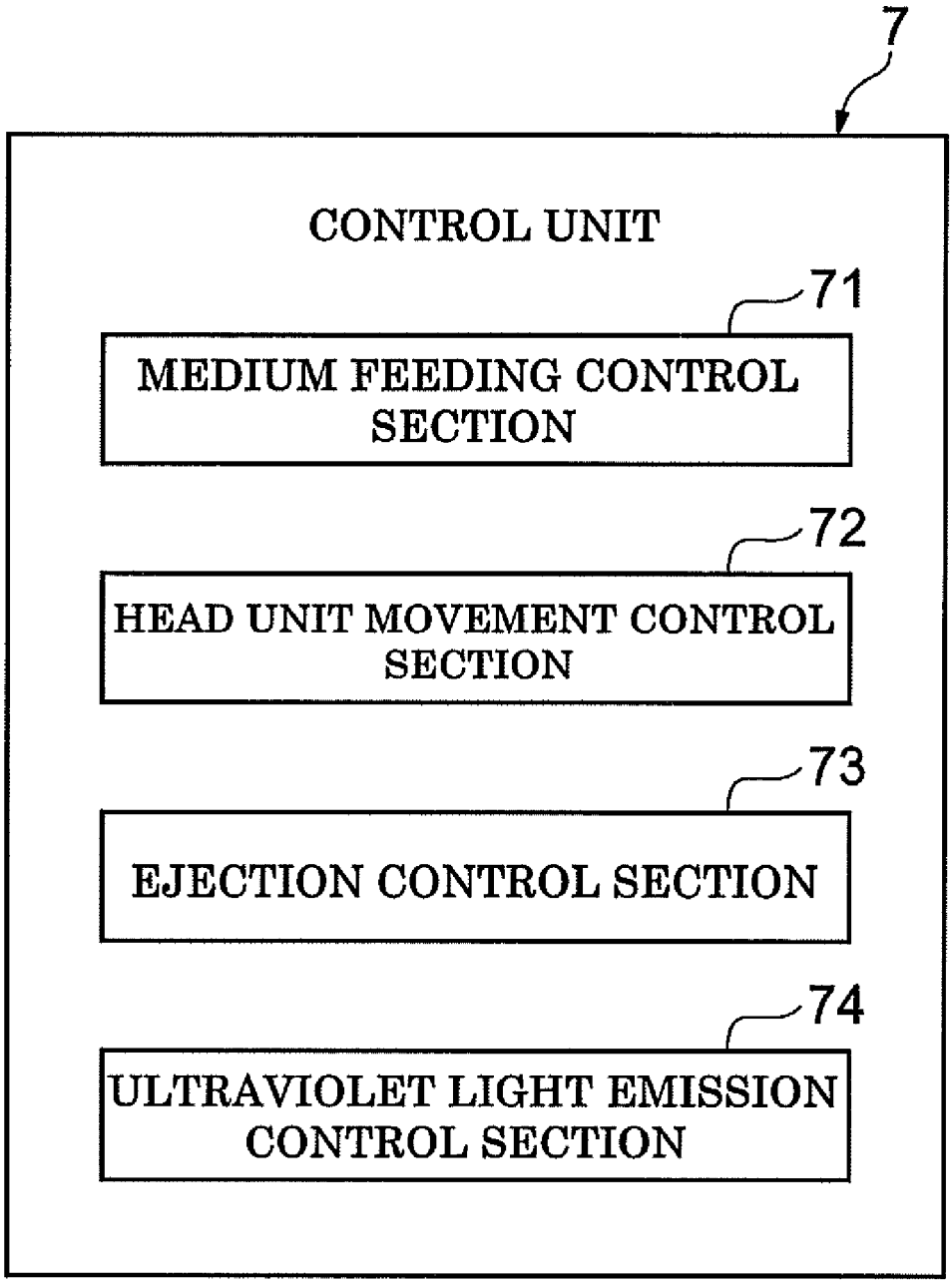
FIG. 3 is an illustration showing an example of functional components of a control unit in the first embodiment.

The control unit 7 controls the feeding rollers 4, the head 6, the imaging inkjet head 11, the backing inkjet head 12, the temporary-curing UVLED 13, and the final-curing UVLED 14 by sending electric signals to the feeding rollers 4, the head 6, the imaging inkjet head 11, the backing inkjet head 12, the temporary-curing UVLED 13, and the final-curing UVLED 14. Therefore, as shown in FIG. 3, the control unit 7 functions as a medium feeding control section 71, a head movement control section 72, an ejection control section 73, and an ultraviolet light emission control section 74. The control unit 7 is mainly composed of a computer including a CPU, a ROM, and a RAM, for example.

The medium feeding control section 71 controls the operation of the feeding rollers 4 to feed the medium 3 on the platen 2 at a pitch corresponding to one line in the feeding direction B after every scan.

The head movement control section 72 controls the operation of the head 6 to move the head 6 at a predetermined speed in the scanning direction A or the direction opposite to the scanning direction A.

The ejection control section 73 controls the ejection of the imaging inkjet head 11 and the backing inkjet head 12 to make the respective inkjet heads 11*a*-11*d* eject the UV inks of yellow Y, magenta M, cyan C and black K, respectively and to make the backing inkjet head 12 eject the UV ink of white W. Ejection controls of the imaging inkjet heads 11*a*-11*d* are conducted from region to region (the region P1, the region P2, the region P3, the region P4).

The ultraviolet light emission control section 74 controls the ultraviolet light emission of the temporary-curing UVLED 13 and the final-curing UVLED 14 to make the temporary-curing UVLED 13 and the final-curing UVLED 14 emit ultraviolet light. The ultraviolet light emission control section 74 adjusts the light intensities of the ultraviolet light emitted from the temporary-curing UVLED 13 and the final-curing UVLED 14 to make the temporary-curing UVLED 13 irradiate the UV inks with ultraviolet light of a light quantity required for temporarily curing the UV inks and to make the final-curing UVLED 14 irradiate the UV inks with ultraviolet light of a light quantity required for finally curing the UV inks. The ultraviolet light emission control section 74 adjusts the light intensities of the ultraviolet light by changing the current flowing in the temporary-curing UVLED 13 and the final-curing UVLED 14. That is, in case that a direct current flows in the temporary-curing UVLED 13 and the final-curing UVLED 14, the light intensity can be changed by changing the current value. In case that a pulse current flows in the temporary-curing UVLED 13 and the final-curing UVLED 14, the light intensity can be changed by changing the pulse width or pulse number.

The UV ink (monomer) has a property that it is cured by polymerization when irradiated with ultraviolet light. The UV ink before irradiated with ultraviolet light (i.e. the UV ink just after deposited on the medium 3) is low-molecular-weight liquid having low viscosity. As the UV ink is irradiated with ultraviolet light of about 20 mJ/cm$^2$ in quantity, the molecular weight of the UV ink is increased and the viscosity is thus increased. This state is the temporarily cured state. The temporarily cured state means, for example, a state that nature of liquid is stronger than nature of solid, that is, the UV ink in this state has a viscosity which is higher than that in the non-cured state but still allows the UV ink to be mixed with non-cured UV ink deposited later thereon. As the UV ink in this state is irradiated with ultraviolet light of about 200 mJ/cm$^2$ in quantity, the molecular weight of the UV ink is further increased. This state is the finally cured state.

Figure 4:
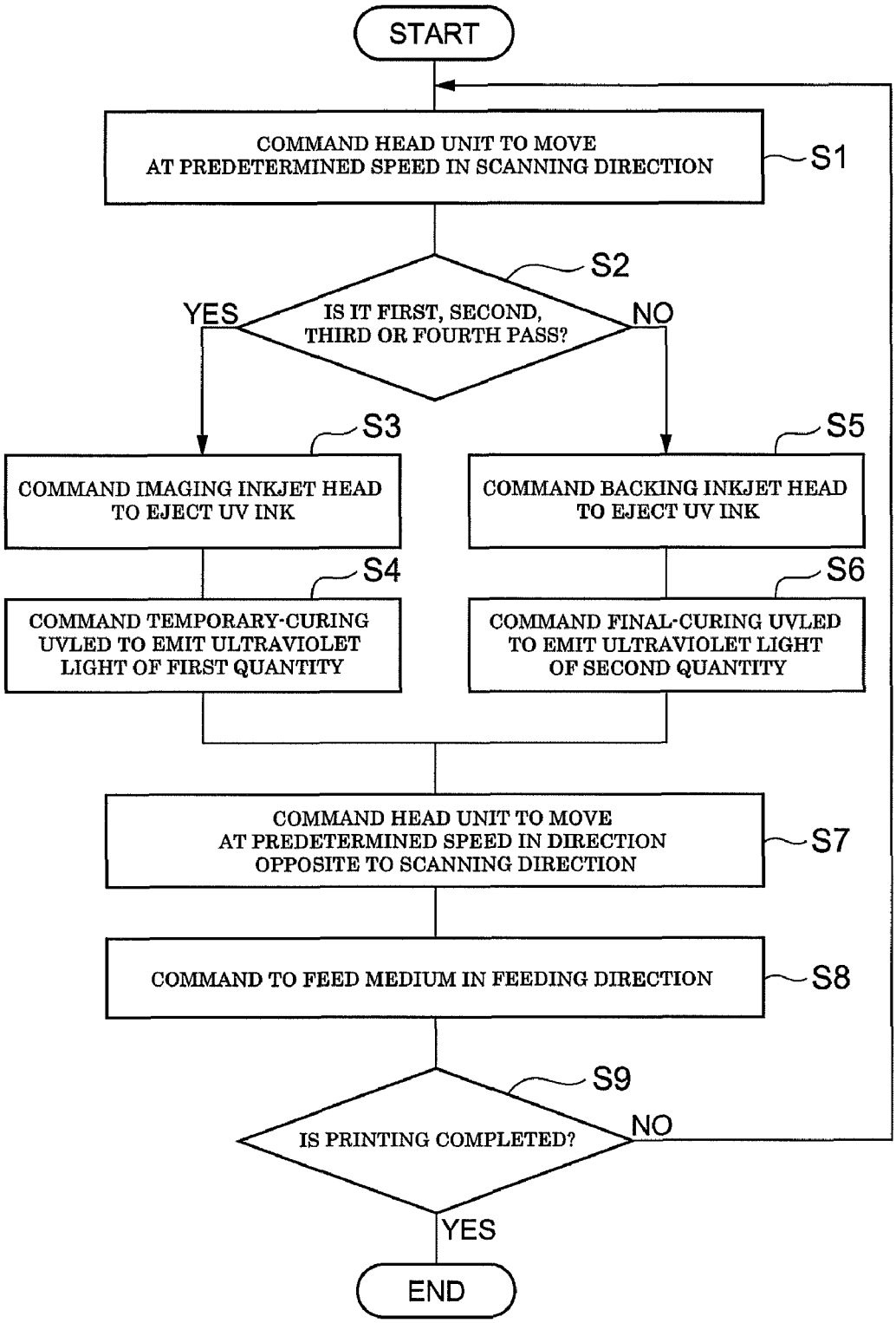
FIG. 4 is a flow chart showing the actions of the control unit in the first embodiment.

Now, the actions of the ultraviolet curing inkjet printer 1 according to this embodiment will be described with reference to FIG. 4. FIG. 4 is a flow chart showing the actions of the control unit. The actions of the ultraviolet curing inkjet printer 1 as will be described below are conducted by the control of the control unit 7. That is, in the control unit 7, a processing section (not shown) composed of a CPU integrally manages respective functions of the medium feeding control section 71, the head movement control section 72, the ejection control section 73, and the ultraviolet light emission control section 74, thereby performing the following processes.

The control unit 7 outputs a command signal for controlling the operation of the feeding rollers 4 to feed the medium 3 on the platen 2 in the feeding direction B so as to set the medium 3 to a print initial position (a print start position in case that the medium 3 is moved for each pass). As the medium 3 is set to the print initial position, the printing control as will be described is conducted. The printing control is conducted by controlling the regions P1 through P5 of the imaging inkjet head 11 and the backing inkjet head 12 for each pass.

The control unit 7 controls the operation of the head 6 and outputs a command signal to command the head 6 to move at a predetermined speed in the scanning direction A (step S1). Then, the head 6 moves at the predetermined speed in the scanning direction A.

In case of print control for the first pass through the fourth pass (step S2: Yes), the control unit 7 outputs a command signal to command the imaging inkjet head 11 to eject UV inks (step S3). That is, in case of printing for the first pass, the control unit 7 controls ejection of the imaging inkjet head 11 of the region P1 and outputs a command signal to command the inkjet heads 11*a*-11*d* to eject the UV inks, respectively when the imaging inkjet heads 11*a*-11*d* reach respective positions where the UV inks are required to be ejected. Thus, the inkjet heads 11*a*-11*d* eject the UV inks of the respective colors at the respective positions where the UV inks are required to be ejected. Similarly to the above case, in case of printing for the second through fourth passes, the control unit 7 controls ejection of the imaging inkjet head 11 of the second through fourth passes and outputs a command signal to command the inkjet heads 11*a*-11*d* to eject the UV inks, respectively when the imaging inkjet heads 11*a*-11*d* reach respective positions where the UV inks are required to be ejected. Thus, the inkjet heads 11*a*-11*d* eject the UV inks of the respective colors at the respective positions where the UV inks are required to be ejected. In this manner, the UV inks are ejected from the imaging inkjet head 11, thereby printing a color image on the medium 3.

Then, the control unit 7 outputs a command signal to command the temporary-curing UVLED 13 to irradiate the UV inks, which are ejected from the respective regions P1 through P4 of the imaging inkjet head 11 and deposited on the medium 3, with ultraviolet light of the first light quantity (step S4). That is, for temporarily curing the UV inks, the control unit 7 sets the light intensity of ultraviolet light emitted from the temporary-curing UVLED 13 to the first light intensity and outputs a command signal to command the temporary-curing UVLED 13 to emit ultraviolet light. Thus, the imaging inkjet head 11 emits the ultraviolet light of the first light intensity. Since the light quantity can be expressed by "light quantity=light intensity×irradiation time," the light quantity is obtained by multiplication of the light intensity with the irradiation time. Therefore, the first light intensity is set in such a manner that the accumulated light quantity (a first light quantity) of ultraviolet light emitted onto the UV inks is 20 $mJ/cm^2$ when the head moves at the predetermined speed.

The imaging inkjet head 11 takes a predetermined offset time to reach a required output level (the first light intensity) after being turned on (starting emission of ultraviolet light). Accordingly, the command of the control unit 7 is preferably conducted, taking the offset time of the imaging inkjet head 11 into consideration, such that the ultraviolet light is emitted only on a printable range of the medium 3. In a step S as will be described later, the same is true for a case that the control unit 7 outputs a command for commanding the backing inkjet head 12 to emit ultraviolet light.

As the UV ink (monomer) is irradiated with the ultraviolet light of which the accumulated light quantity is 20 $mJ/cm^2$ in the step S4, the UV ink has increased viscosity because the molecular weight is increased so that the UV ink is temporarily cured.

On the other hand, in case of print control for the fifth pass (step S2: No), the control unit 7 outputs a command signal to command the backing inkjet head 12 to eject UV ink (step S5). That is, the control unit 7 controls ejection of the backing inkjet head 12 of the region P5 and outputs a command signal to command the backing inkjet head 12 to eject the UV ink when the backing inkjet head 12 reaches a position where the UV ink is required to be ejected as printing for the fifth pass with regard to the line on which the printing for first through fourth pass are completed and the color image is thus formed. Thus, the backing inkjet head 12 ejects the UV ink of white color at the position on the line for the fifth pass where the UV ink is required to be ejected. In this manner, the UV ink is ejected from the backing inkjet head 12, thereby backing the color image printed on the medium 3 with the UV ink of white color.

Then, the control unit 7 outputs a command signal to command the final-curing UVLED 14 to irradiate the UV inks, which are ejected from the respective regions P1 through P4 of the imaging inkjet head 11 and deposited on the medium 3, and the UV ink, which is ejected from the region P5 of the backing inkjet head 12 and deposited on the medium 3, with ultraviolet light of the second light quantity (step S6). That is, for finally curing the UV inks, the control unit 7 sets the light intensity of ultraviolet light emitted from the final-curing UVLED 14 to the second light intensity and outputs a command signal to command the final-curing UVLED 14 to emit ultraviolet light. Thus, the final-curing UVLED 14 emits the ultraviolet light of the second light intensity. Therefore, the second light intensity is set in such a manner that the accumulated light quantity of ultraviolet light irradiating the UV inks is 200 $mJ/cm^2$ when the head 6 moves at the predetermined speed. As the UV inks (monomer) are irradiated with ultraviolet light of 200 $mJ/cm^2$ in accumulated light quantity, the molecular weight of the UV inks is further increased, thereby finally curing the UV inks.

As the step S4 or the step S6 is terminated, the control unit 7 conducts the operation of the head 6 and outputs a command signal to command the head 6 to move at the predetermined speed in the direction opposite to the scanning direction A to return to the standby position (step S7). Then, the head 6 moves in the direction opposite to the scanning direction A to return to the standby position.

The, the control unit 7 conducts the operation of the feeding rollers 4 and to outputs a command signal to command the feeding rollers 4 to feed the medium 3 in the feeding direction B for a distance corresponding to one line (step S8). Then, the feeding rollers 4 feed the medium 3 in the feeding direction for the distance corresponding to one line. Thus, the medium 3 is set at a printing position for the next pass.

Then, the control unit 7 determines whether or not printing is completed (step S9). When, in the step S9, it is determined that the printing is not completed (step S9: No), the control unit 7 returns to the step S1 and repeats the aforementioned processes (step S1 through step S8). On the other hand, when, in the step S9, it is determined that the printing is completed (step S9: Yes), the control unit 7 terminates the printing process.

FIG. 5 through FIG. 9 are illustrations for explaining the printing process of the ultraviolet curing inkjet printer.

Figure 5:
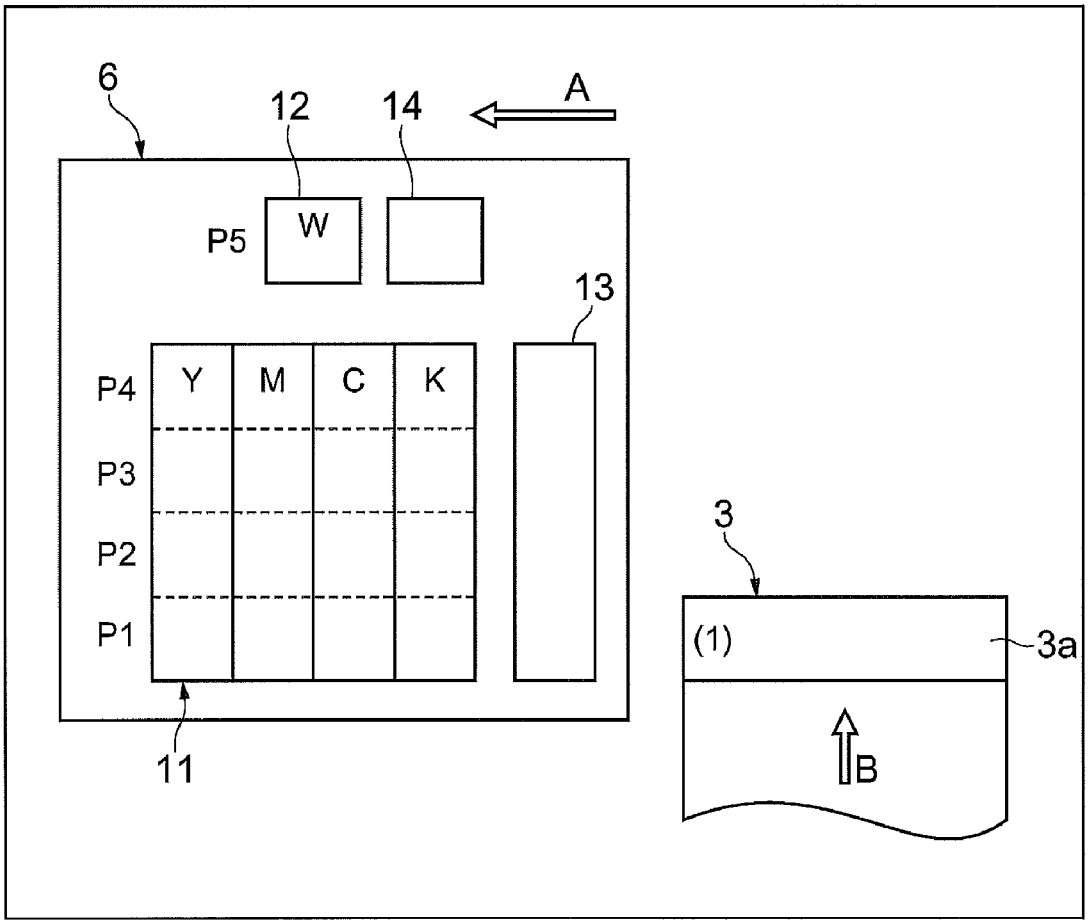
FIG. 5 is an illustration for explaining the printing process of the ultraviolet curing inkjet printer.

As shown in FIG. 5, the head 6 is moved in the scanning direction A so that the imaging inkjet head 11 scans a line 3*a* of the medium 3. Thus, a first layer of a color image is formed on the line 3*a* with UV inks (1) ejected from the region P1 of the imaging inkjet head 11 (the first pass). The temporary-curing UVLED 13 emits ultraviolet light of the first light intensity to temporarily cure the UV inks (1).

Figure 6:
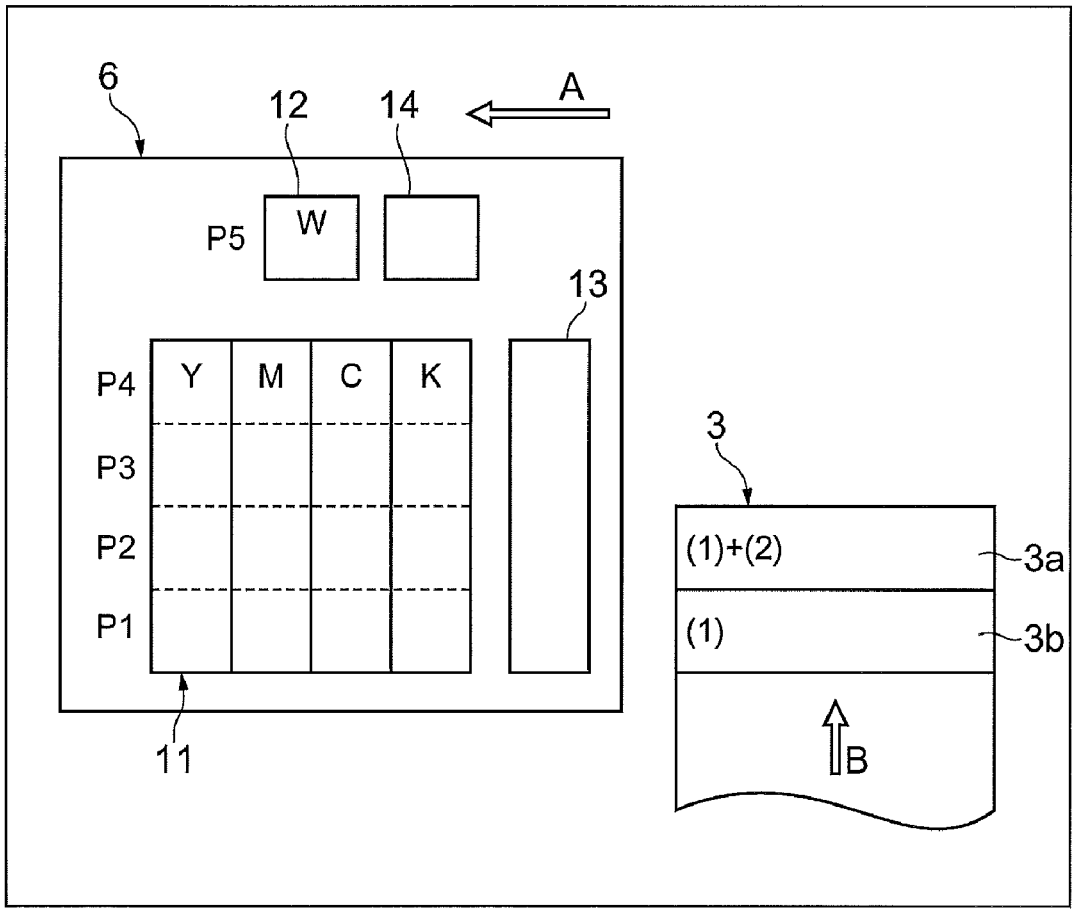
FIG. 6 is an illustration for explaining the printing process after the medium is fed in the feeding direction for a distance corresponding to one line from the state shown in FIG. 5.

After that, as shown in FIG. 6, the medium is fed in the feeding direction B for a distance corresponding to one line and the head 6 moves in the scanning direction A so that the imaging inkjet head 11 scans the line 3*a* and a line 3*b* of the medium 3. Thus, a first layer of a color image is formed on the line 3*b* with the UV inks (1) ejected from the region P1 of the imaging inkjet head 11 (the first pass). On the other hand, a second layer of the color image is formed on the line 3*a* with UV inks (2) ejected from the region P2 of the imaging inkjet head 11 (the second pass). That is, on the line 3*a*, the UV inks (2) for the second layer are superposed on the temporarily cured UV inks (1) for the first layer. Then, the temporary-curing UVLED 13 emits ultraviolet light of the first light intensity to temporarily cure the UV inks (1) and the UV inks (2).

Figure 7:
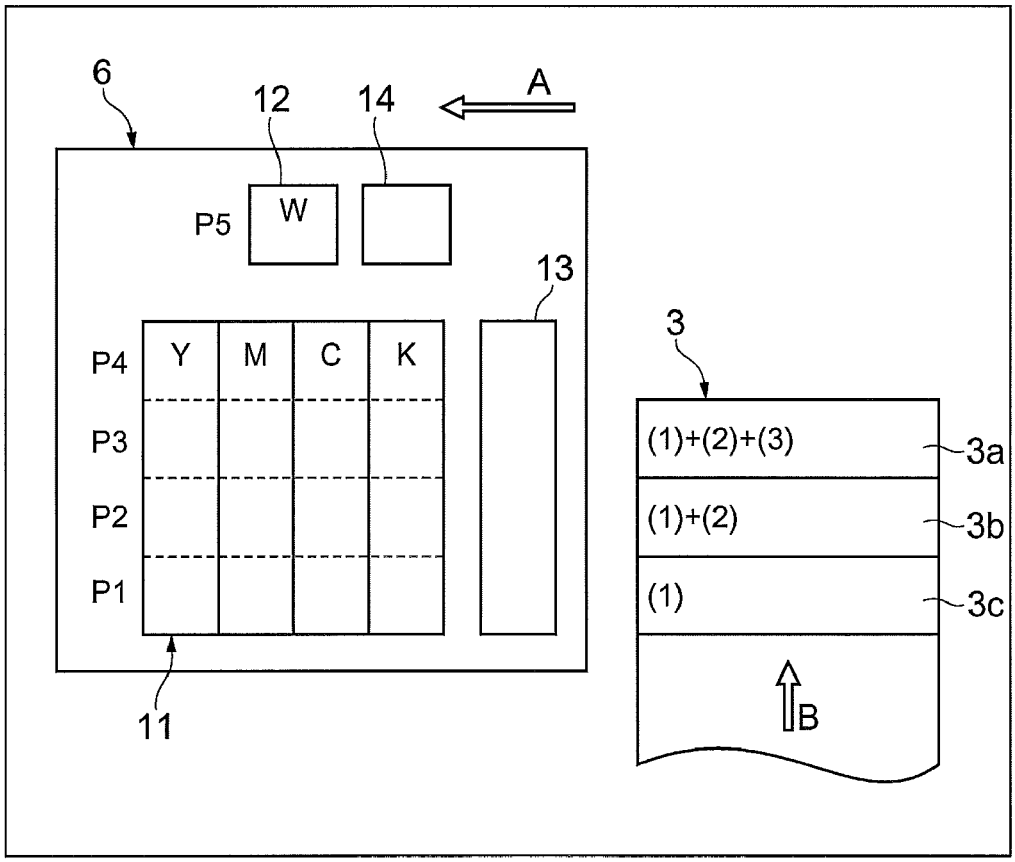
FIG. 7 is an illustration for explaining the printing process after the medium is fed in the feeding direction for a distance corresponding to one line from the state shown in FIG. 6.

After that, as shown in FIG. 7, the medium is fed in the feeding direction B for a distance corresponding to one line from the state shown in FIG. 6 and the head 6 moves in the scanning direction A so that the imaging inkjet head 11 scans the line 3*a*, the line 3*b*, and a line 3*c* of the medium 3. Thus, a first layer of a color image is formed on the line 3*c* with the UV inks (1) ejected from the region P1 of the imaging inkjet head 11 (the first pass), a second layer of the color image is formed on the line 3*b* with the UV inks (2) ejected from the region P2 of the imaging inkjet head 11 (the second pass), and a third layer of the color image is formed on the line 3*a* with UV inks (3) ejected from the region P3 of the imaging inkjet head 11 (the third pass). That is, on the line 3*b*, the UV inks (2) for the second layer are superposed on the temporarily cured UV inks (1) for the first layer. On the line 3*a*, the UV inks (3) for the third layer are superposed on the temporarily cured UV inks (2) for the second layer. Then, the temporary-curing UVLED 13 emits ultraviolet light of the first light intensity to temporarily cure the UV inks (1), the UV inks (2), and the UV inks (3).

Figure 8:
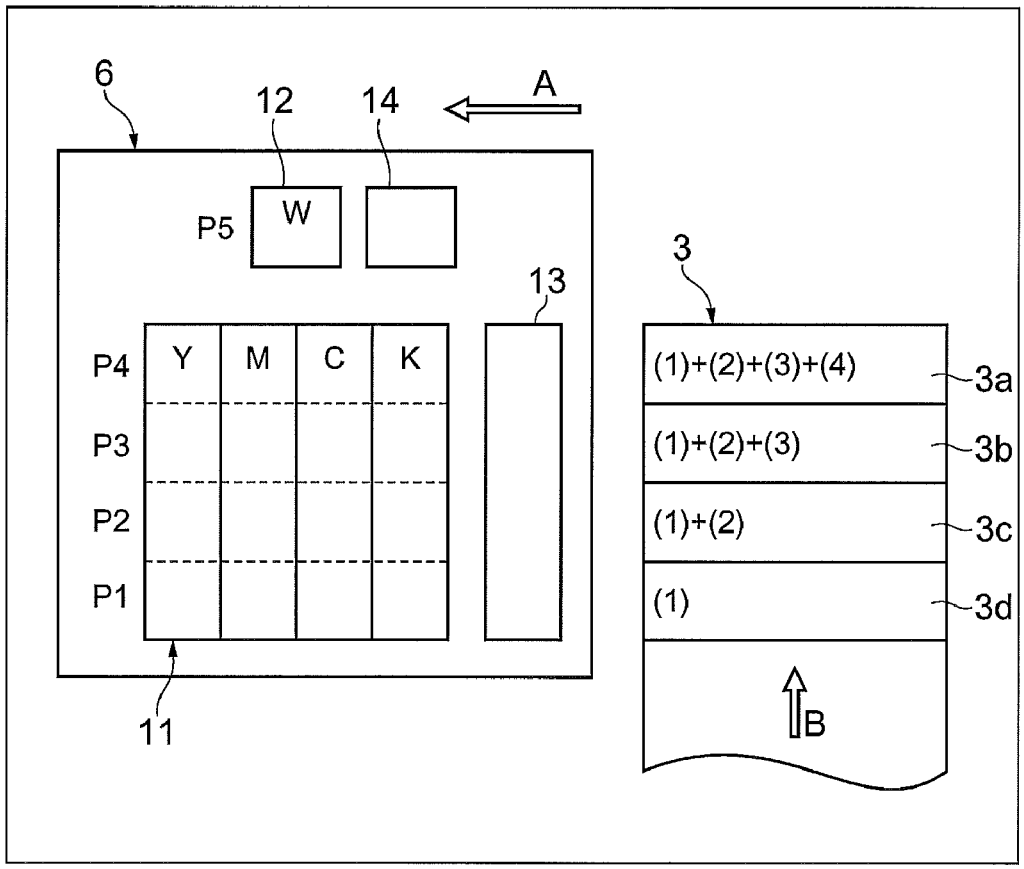
FIG. 8 is an illustration for explaining the printing process after the medium is fed in the feeding direction for a distance corresponding to one line from the state shown in FIG. 7.

After that, as shown in FIG. 8, the medium is fed in the feeding direction B for a distance corresponding to one line from the state shown in FIG. 7 and the head 6 moves in the scanning direction A so that the imaging inkjet head 11 scans the line 3*a*, the line 3*b*, the line 3*c*, and a line 3*d* of the medium 3. Thus, a first layer of a color image is formed on the line 3*d* with the UV inks (1) ejected from the region P1 of the imaging inkjet head 11 (the first pass), a second layer of the color image is formed on the line 3*c* with the UV inks (2) ejected from the region P2 of the imaging inkjet head 11 (the second pass), a third layer of the color image is formed on the line 3*b* with the UV inks (3) ejected from the region P3 of the imaging inkjet head 11 (the third pass), and a fourth layer of the color image is formed on the line 3*a* with UV inks (4) ejected from the region P4 of the imaging inkjet head 11 (the fourth pass). That is, on the line 3*c*, the UV inks (2) for the second layer are superposed on the temporarily cured UV inks (1) for the first layer. On the line 3*b*, the UV inks (3) for the third layer are superposed on the temporarily cured UV inks (2) for the second layer. Further on the line 3*a*, the UV inks (4) for the fourth layer are superposed on the temporarily cured UV inks (3) for the third layer. Then, the temporary-curing UVLED 13 emits ultraviolet light of the first light intensity to temporarily cure the UV inks (1), the UV inks (2), the UV inks (3), and the UV inks (4).

Figure 9:
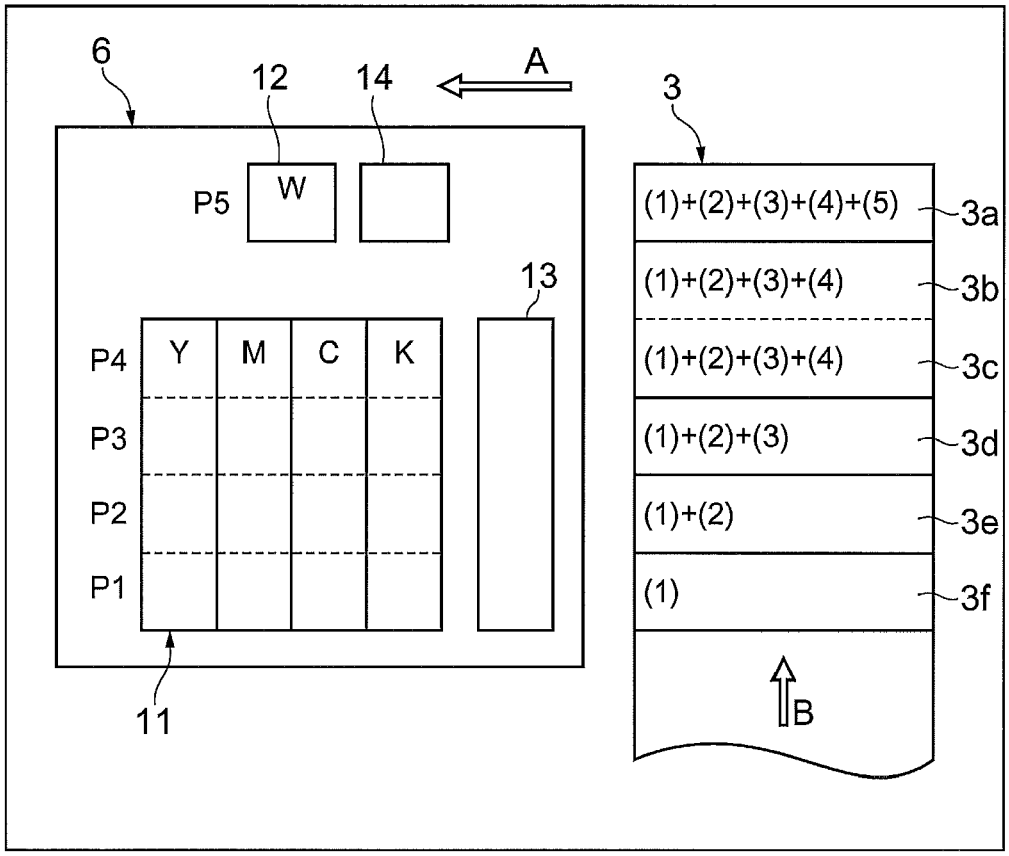
FIG. 9 is an illustration for explaining the printing process after the medium is fed in the feeding direction for a distance corresponding to two lines from the state shown in FIG. 8.

After that, as shown in FIG. 9, the medium is fed in the feeding direction B for a distance corresponding to two lines from the state shown in FIG. 8 and the head 6 moves in the scanning direction A so that the imaging inkjet head 11 scans the line 3*c*, the line 3*d*, a line 3*e*, and a line 3*f* of the medium 3, and the backing inkjet head 12 scans the line 3*a* of the medium 3. Similarly to the scans shown in FIG. 8, first through fourth layers of the color image is formed on the lines 3*c* through 3*f* and the UV inks (1) through (4) are temporarily cured. On the other hand, the line 3*a* is advanced to a portion in front of the imaging inkjet head 11 in the feeding direction so that the color image is already formed with the UV inks (1) through (4) ejected from the region P1 through P4 of the imaging inkjet head 11. On the line 3*a*, a ground color layer as the fifth layer is formed with UV inks (5) ejected from the region P5 of the backing inkjet head 12 (the fifth pass). That is, since the backing inkjet head 12 scans the line 3*a*, the ground color layer is formed so as to back the color image. Then, the final-curing UVLED 14 emits ultraviolet light of the second light intensity to finally cure the UV inks (1) through (5) formed on the line 3*a*. That is, the UV inks (1) through (4) ejected from the imaging inkjet head 11 and the UV ink (5) ejected from the backing UV ink (5) are finally cured.

Figure 10A:
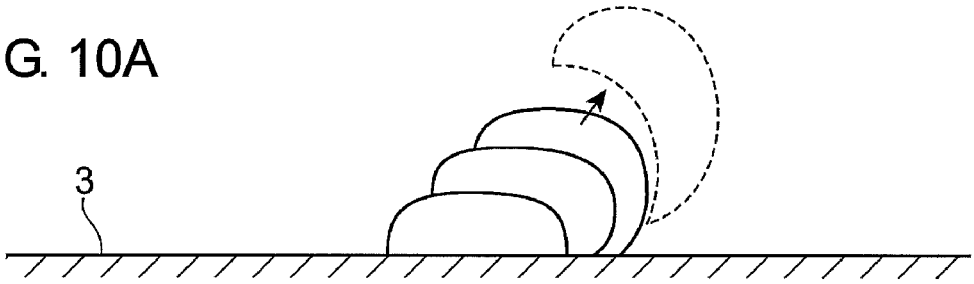
Figure 10B:
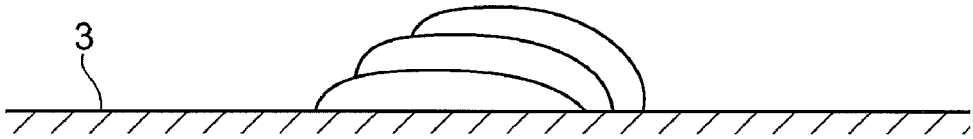

FIGS. 10A and 10B are illustrations showing laminated structures of UV inks, wherein FIG. 10A shows a laminated structure of UV inks in case of being scanned by a conventional ultraviolet curing inkjet printer in which a final-curing UVLED is disposed posterior to the imaging inkjet head 11 in the scanning direction A and FIG. 10B shows a laminated structure of UV inks in case of being scanned by the ultraviolet curing inkjet printer according to this embodiment. As shown in FIG. 10A, in case that the final-curing UVLED is disposed posterior to the imaging inkjet head in the scanning direction A, UV inks are finally cured after each scan of the imaging inkjet head. Therefore, upper layer UV inks at the tops cannot be mixed with lower layer UV inks and, in addition, the UV inks are cured with large thickness so that the upper layer UV inks are liable to be stripped because it is rejected by the lower layer UV inks. However, as shown in FIG. 10B, in case that the final-curing UVLED 14 is disposed anterior to the imaging inkjet head 11 in the feeding direction B, the UV inks are not finally cured until all passes are completed and are temporarily cured so that the UV inks of respective layers are leveled and are mixed with each other. Therefore, the lower layer UV inks and the upper layer UV inks are strongly bonded.

As mentioned above, in the ultraviolet curing inkjet printer 1 according to this embodiment, the imaging inkjet head 11 eject UV inks to a plurality of lines. Therefore, by feeding the medium 3 in the feeding direction B, the imaging inkjet head 11 ejects UV inks a plurality of times on the same lines so that the UV inks are superposed. Since the final-curing UVLED 14 is disposed anterior to the imaging inkjet head 11 in the feeding direction B, the UV inks on the scanned lines are irradiated with ultraviolet light of the first light quantity from the temporary-curing UVLED 13 but are not irradiated with ultraviolet light of the second light quantity from the final-curing UVLED 14 until all ejections of UV inks by the imaging inkjet head 11 are completed. Therefore, the UV inks superposed by the imaging inkjet head 11 are in the temporarily cured state. That is, the lower layer UV inks are not yet finally cured and are thus allowed to be mixed with the upper layer UV inks. In other words, the lower layer temporarily cured UV inks have a viscosity which is higher than that of non-cured UV inks but still allows the UV inks to be mixed with non-cured UV inks deposited later thereon. The temporarily cured UV inks have less uneven, i.e. are leveled. After that, the final-curing UVLED14 emits ultraviolet light of the second light quantity to the scanned line on which all scans by the imaging inkjet head 11 are completed. According to this embodiment, the superposed UV inks are finally cured in the mixed state, thereby improving the printing strength in case of printing by the multipass method.

Since the backing inkjet head 12 is disposed anterior to the imaging inkjet head 11 in the feeding direction B, the backing inkjet head 12 ejects UV ink to the scanned line on which all ejections of UV inks by the imaging inkjet head 11 are completed. Therefore, the color image formed by the UV inks ejected from the imaging inkjet head 11 is backed by a ground color layer formed by the UV ink ejected from the backing inkjet head 12. Accordingly, the color image printed on the transparent medium 3 can be displayed more vibrantly. In addition, since the backing inkjet head 12 is disposed anterior to the final-curing UVLED in the scanning direction A, the UV inks ejected from the imaging inkjet head 11 and the UV ink ejected from the backing inkjet head 12 are finally cured by the final-curing UVLED 14 at once.

Since the control unit 7 changes the light quantities emitted from the temporary-curing UVLED 13 and the final-curing UVLED 14, the temporary-curing UVLED 13 and the final-curing UVLED 14 can emit ultraviolet light of the first light quantity and ultraviolet light of the second light quantity, respectively, even though the temporary-curing UVLED 13 and the final-curing UVLED 14 are not exclusive products for emitting ultraviolet light of the first light quantity and the second light quantity, thereby reducing the cost.

Since the light quantity is proportional to the light intensity, the temporary-curing UVLED 13 and the final-curing UVLED 14 can emit ultraviolet light of the first light quantity and ultraviolet light of the second light quantity easily, respectively, by changing the light intensities of ultraviolet light emitted from the temporary-curing UVLED 13 and the final-curing UVLED 14.

Though the preferred embodiment of the present invention has been described, the present invention is not limited to the aforementioned embodiments. For example, though the imaging inkjet head 11, the backing inkjet head 12, and the temporary-curing UVLED 13 and the final-curing UVLED 14 are integrally arranged as the head 6 in the aforementioned embodiment, parts or all of these may be separately formed as discrete parts.

Figure 11:
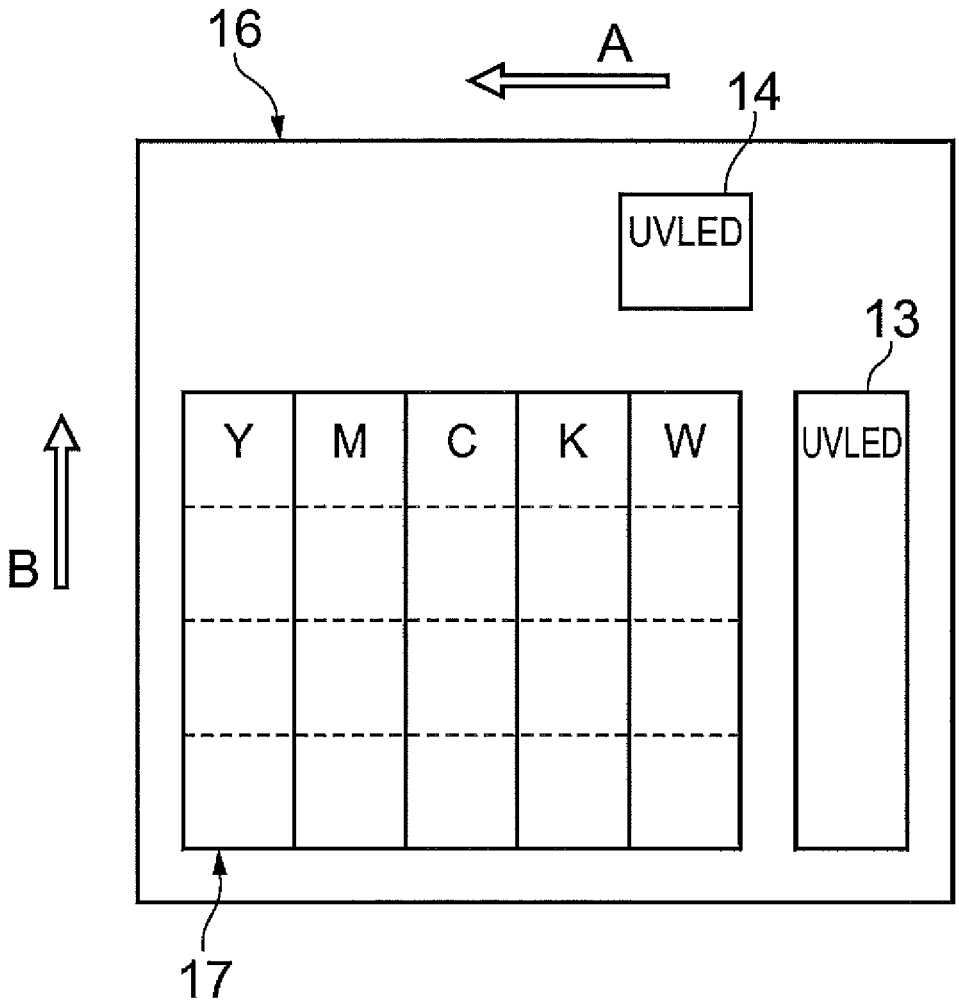
FIG. 11 is an illustration showing another structure example of a head.
Figure 12:
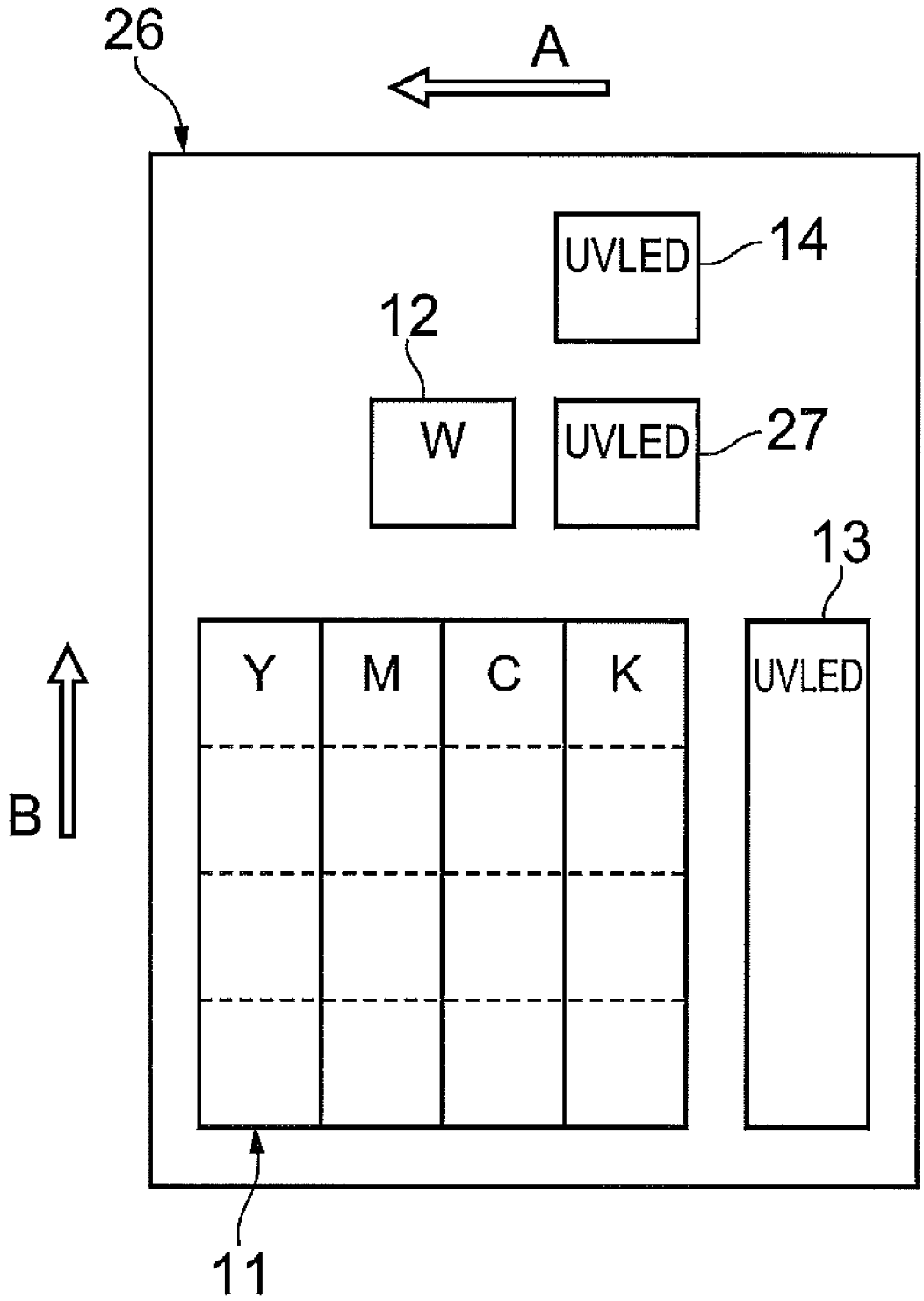
FIG. 12 is an illustration showing another structure example of a head.
Figure 13:
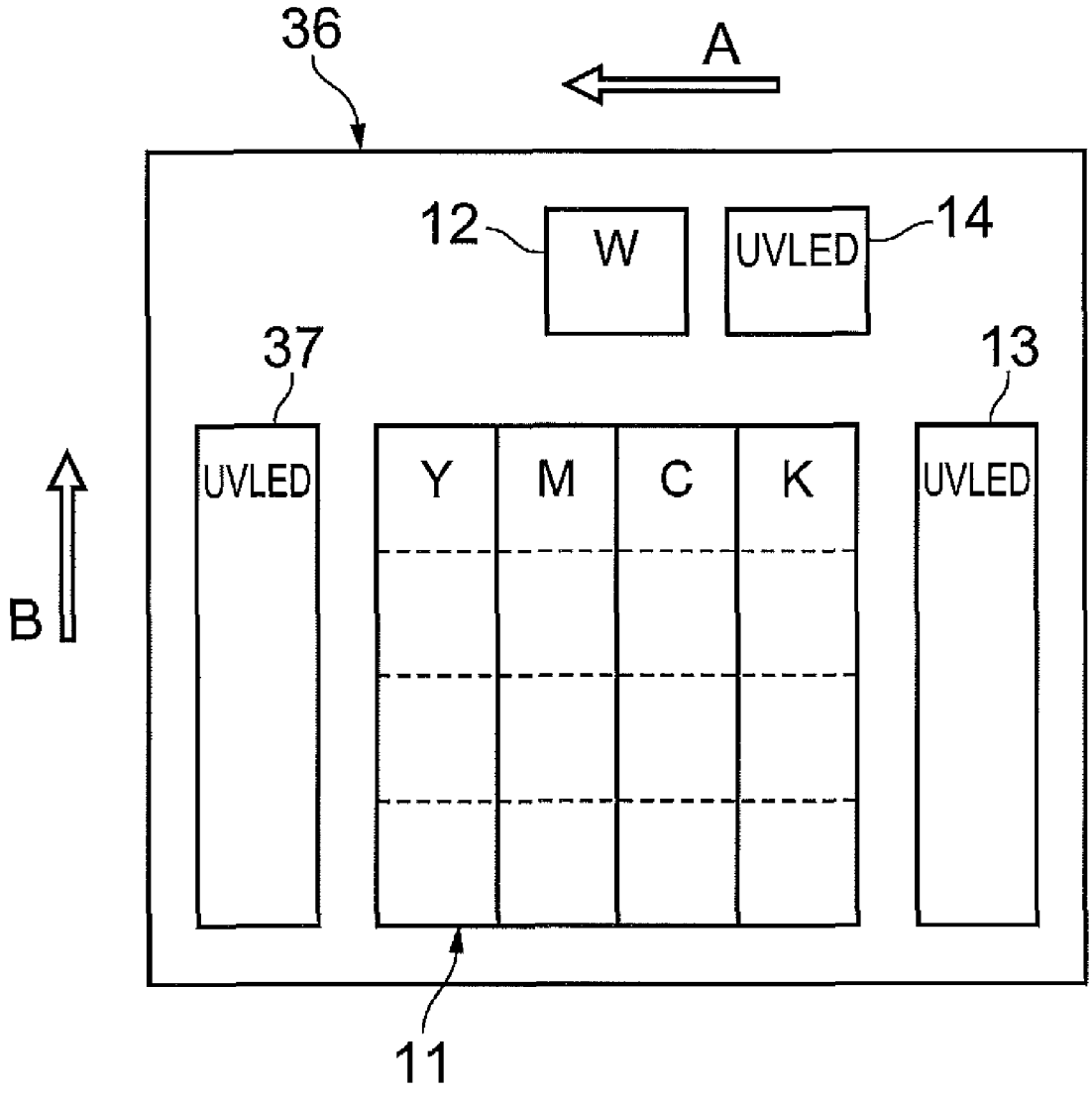
FIG. 13 is an illustration showing another structure example of a head.

The head 6 is not limited to have the aforementioned structure and may have structures shown as heads 16, 26, 36 as shown in FIG. 11 through FIG. 13.

A head 16 shown in FIG. 11 includes an integrated inkjet head 17 having an imaging inkjet head and a backing inkjet head which are integrated, a temporary-curing UVLED 13 which is disposed posterior to the integrated inkjet head 17 in the scanning direction A, and a final-curing UVLED 14 which is disposed anterior to the integrated inkjet head 17 in the feeding direction B. According to the head 16, formation of a color image and backing of the color image by the integrated inkjet head 17 and temporary curing by the temporary-curing UVLED 13 are conducted for each scan. After the scan by the integrated inkjet head 17 is completed, UV inks are finally cured by the final-curing UVLED 14.

A head 26 shown in FIG. 12 includes an imaging inkjet head 11, a temporary-curing UVLED 13 which is disposed posterior to the imaging inkjet head 11 in the scanning direction A, a backing inkjet head 12 which is disposed anterior to the imaging inkjet head 11 in the feeding direction B, a temporary-curing UVLED 27 which is disposed anterior to the imaging inkjet head 11 in the feeding direction B and posterior to the backing inkjet head 12 in the scanning direction A, and a final-curing UVLED 14 which is disposed anterior to the temporary-curing UVLED 27 in the feeding direction B. The temporary-curing UVLED 27 is a UVLED for irradiating UV inks with ultraviolet light of the first light quantity similarly to the temporary-curing UVLED 13. According to the head 26, formation of a color image by the imaging inkjet head 11 and temporary curing of UV inks by the temporary-curing UVLED 13 are conducted for each scan. After the scan by the imaging inkjet head 11 is completed, the color image is backed by the operation of the backing inkjet head 12 and the UV inks are temporarily cured. After that, the UV inks are finally cured by the final-curing UVLED 14.

A head 36 shown in FIG. 13 includes an imaging inkjet head 11, a temporary-curing UVLED 13 which is disposed posterior to the imaging inkjet head 11 in the scanning direction A, a temporary-curing UVLED 37 which is disposed anterior to the imaging inkjet head 11 in the scanning direction A, a backing inkjet head 12 which is disposed anterior to the imaging inkjet head 11 in the feeding direction B, and a final-curing UVLED 14 which is disposed anterior to the imaging inkjet head 11 in the feeding direction B and posterior to the backing inkjet head 12 in the scanning direction A. The temporary-curing UVLED 37 is a UVLED for irradiating UV inks with ultraviolet light of the first light quantity similarly to the temporary-curing UVLED 13. The head 36 having this structure scans not only while moving in the scanning direction A but also while moving in the direction opposite to the scanning direction A. That is, scan is conducted twice by reciprocating the head 36. According to the head 36, formation of a color image by the imaging inkjet head 11 and temporary curing of UV inks by the temporary-curing UVLED 13 or the temporary-curing UVLED 37 are conducted for each scan. After the scan by the imaging inkjet head 11 is completed, the UV inks are finally cured by the final-curing UVLED 14 while the color image is backed by the operation of the backing inkjet head 12.

Though the control unit 7 changes the light quantities of ultraviolet light for irradiating UV inks by changing the light intensities of ultraviolet light of temporary-curing UVLED 13 and the final-curing UVLED 14 in the aforementioned embodiments, the light quantity of ultraviolet light may be changed by changing the moving speed of the head 6 (the temporary-curing UVLED 13 and the final-curing UVLED 14). The irradiation time that the UV inks deposited on the medium 3 are irradiated with ultraviolet light can be changed by changing the moving speed of the head 6, thereby easily changing the light quantities of ultraviolet light emitted from the temporary-curing UVLED 13 and the final-curing UVLED 14.

Though the UV inks are temporarily cured when being irradiated with ultraviolet light of which light quantity is 20 $mJ/cm^2$ and the UV inks are finally cured when being irradiated with ultraviolet light of which light quantity is 200 $mJ/cm^2$ in the aforementioned embodiments, the light quantities of ultraviolet light required for the temporary curing and the final curing depend on various factors such as components of UV ink and are thus set suitably.

Though UVLEDs are employed as the ultraviolet light irradiation means in the aforementioned embodiments, any device capable of emitting ultraviolet light such as UV lamp may be employed. Further, the number of UVLEDs arranged in the UVLED unit may be one or plural.

Though the ultraviolet curing inkjet printer 1 is provided with the feeding rollers 4 for feeding the medium 3 in the aforementioned embodiments, another mechanism not the feeding rollers 4 may be employed to feed the medium 3.

Though the head 6 and the medium 3 are moved relative to each other by feeding the medium 3 in the feeding direction B in the aforementioned embodiment, the head 6 may be moved instead of the medium 3 or both of the head 6 and the medium 3 may be moved. For example, the present invention may be applied to an ultraviolet curing inkjet printer of flat-bed-type which includes a flat bed on which a medium 3 is put and fixed and a mechanism for moving the head 6 in the feeding direction B and a direction opposite to the feeding direction B. Even with the ultraviolet curing inkjet printer of flat-bed-type, the head 6 and the medium 3 can be moved relative to each other in the feeding direction B, thereby obtaining the same works and effects of the aforementioned ultraviolet curing inkjet printer 1 in which the medium 3 is fed in the feeding direction B. In case of the ultraviolet curing inkjet printer of flat-bed-type, the head 6 moves in the direction opposite to the feeding direction B so that the direction opposite to the moving direction of the head 6 is a direction (the second direction) in which the medium 3 moves relative to the head 6.

An embodiment of the present invention includes an ultraviolet curing inkjet printer of a type in which a same line on a recording medium is scanned a plurality of times by a head ejecting ultraviolet curable inks, and is characterized by including a first ejecting means for ejecting ultraviolet curable inks to a plurality of lines on the recording medium; a first ultraviolet light irradiation means which is disposed posterior to the first ejecting means in a first direction as the scanning direction and emits ultraviolet light of a first light quantity for temporarily curing the ultraviolet curable inks ejected from the first ejecting means; and a second ultraviolet light irradiation means which is disposed anterior to the first ejecting means in a second direction, which is perpendicular to the first direction and is the moving direction of the recording medium relative to the head, and emits ultraviolet light of a second light quantity for finally curing the ultraviolet curable inks temporarily cured by the first ultraviolet light irradiation means.

In the embodiment of the ultraviolet curing inkjet printer of the present invention, the first ejecting means ejects ultraviolet curable inks on a plurality of lines so that ultraviolet curable inks are ejected on a same line a plurality of times from the first ejecting means and are superposed on each other so as to form a color image. Since the second ultraviolet light irradiation means is disposed anterior to the first ejecting means in the second direction, the scanned lines are not irradiated with ultraviolet light of the second light quantity from the second ultraviolet light irradiation means while the scanned lines are irradiated with ultraviolet light of the first light quantity from the first ultraviolet light irradiation means until all ejections of ultraviolet curable inks by the first ejecting means are completed. Accordingly, the ultraviolet curable inks superposed by the first ejecting means are in temporarily cured state. That is, the lower layer ultraviolet curable ink is not finally cured and is thus allowed to be mixed with the upper layer ultraviolet curable ink. In other words, the temporarily cured ultraviolet curable ink has a viscosity which is higher than that of a non-cured UV ink but still allows the UV ink to be mixed with non-cured UV ink deposited later thereon. In addition, the temporarily cured UV ink has less uneven, i.e. is leveled. After that, the ultraviolet light of the second light quantity is emitted from the second ultraviolet light irradiation means to the scanned line on which all scans by the first ejecting means are completed. According to the embodiment, the superposed ultraviolet curable inks are finally cured in the mixed state, thereby improving the printing strength in case of printing by the multipass method.

In this case, the ultraviolet curing inkjet printer preferably further includes a second ejecting means which is disposed anterior to the first ejecting means in the second direction and is disposed anterior to the second ultraviolet light irradiation means in the first direction or posterior to the second ultraviolet light irradiation means in the second direction.

According to the embodiment of the ultraviolet curing inkjet printer, the second ejecting means is disposed anterior to the first ejecting means in the second direction so that the second ejection means ejects ultraviolet curable ink to the scanned line on which all ejections of ultraviolet curable inks by the first ejecting means are completed. Therefore, the printed layers formed by the ultraviolet curable inks ejected from the first ejecting means is covered by a printed layer formed by the ultraviolet curable ink ejected from the second ejecting means. Accordingly, for example, the printed layers formed by the first emitting means can be protected by the printed layer formed by the second ejecting means. In case of printing on a transparent or semi-transparent recording medium, the printed layer formed by the second ejecting means can visually accentuate the printed layers formed by the first ejecting means. In addition, since the second ejecting means is disposed anterior to the second ultraviolet light emitting means in the first direction or posterior to the second ultraviolet light emitting means in the second direction, the ultraviolet curable inks ejected from the first ejecting means and the ultraviolet curable ink ejected from the second ejecting means are finally cured by the second ultraviolet light emitting means at the same time.

It is preferable that the first ejecting means ejects the ultraviolet curable inks to form an image and the second ejecting means ejects the ultraviolet curable ink to form a ground color layer. According to the ultraviolet curing inkjet printer, the ground color layer formed by the second ejecting means is superposed on the top of the image formed by the first ejecting means. Therefore, in case of printing an image on a transparent or semi-transparent recording medium, the image can be displayed more vibrantly.

The ultraviolet curing inkjet printer preferably further includes a light quantity changing means which changes the light quantities of ultraviolet light emitted from the first ultraviolet light irradiation means and the second ultraviolet light irradiation means. According to the ultraviolet curing inkjet printer, the first ultraviolet light irradiation means and the second ultraviolet light irradiation means can emit ultraviolet light of the first light quantity and ultraviolet light of the second light quantity, respectively, even though the first ultraviolet light irradiation means and the second ultraviolet light irradiation means are not exclusive products for emitting ultraviolet light of the first light quantity and the second light quantity, thereby reducing the cost.

The light quantity changing means may change the light quantities of ultraviolet light for irradiating the ultraviolet curable inks by changing the light intensities of ultraviolet light emitted from the first ultraviolet light irradiation means and the second ultraviolet light irradiation means. According to the ultraviolet curing inkjet printer, since the light quantity is proportional to the light intensity, the first ultraviolet light irradiation means and the second ultraviolet light irradiation means can emit ultraviolet light of the first light quantity and ultraviolet light of the second light quantity easily, respectively, by changing the light intensities of ultraviolet light emitted from the first ultraviolet light irradiation means and the second ultraviolet light irradiation means.

On the other hand, the light quantity changing means may change the light quantities of ultraviolet light for irradiating the ultraviolet curable inks by changing the moving speed of the first ultraviolet light irradiation means and the second ultraviolet light irradiation means. According to the ultraviolet curing inkjet printer, the irradiation time that the ultraviolet curable inks deposited on the recording medium are irradiated with ultraviolet light can be changed by changing the moving speed of the ultraviolet light irradiation means. In other words, since the light quantity is proportional to the irradiation time, the first ultraviolet light irradiation means and the second ultraviolet light irradiation means can emit ultraviolet light of the first light quantity and ultraviolet light of the second light quantity easily, respectively, by changing the moving speed of the first ultraviolet light irradiation means and the second ultraviolet light irradiation means.

An embodiment of a printing method used in an ultraviolet curing inkjet printer of the present invention is a printing method used in an ultraviolet curing inkjet printer of a type in which a same line on a recording medium is scanned a plurality of times by a head ejecting ultraviolet curable inks and is characterized by including a first ejecting step of ejecting ultraviolet curable inks to a plurality of lines on the recording medium; a first ultraviolet light irradiation step of emitting ultraviolet light of a first light quantity for temporarily curing the ultraviolet curable inks ejected in the first ejecting step; and a second ultraviolet light irradiation step of emitting ultraviolet light of a second light quantity for finally curing the ultraviolet curable inks temporarily cured in the first ultraviolet light irradiation step after all scans for a same line by the first ejecting step are completed.

In the embodiment of the printing method of the present invention, ultraviolet curable inks are ejected on a plurality of lines in the first ejecting step so that ultraviolet curable inks are ejected on a same line a plurality of times and are superposed on each other so as to form a color image. The scanned line is irradiated by ultraviolet light of the first light quantity by the first ultraviolet light irradiation step, but not irradiated by ultraviolet light of the second light quantity until all ejections of the ultraviolet curable inks by the first ejecting step are completed. Accordingly, the ultraviolet curable inks superposed by the first ejecting step are in temporarily cured state. That is, the lower layer ultraviolet curable ink is not finally cured and is thus allowed to be mixed with the upper layer ultraviolet curable ink. In other words, the temporarily cured ultraviolet curable ink in this embodiment of the invention has a viscosity which is higher than that of a non-cured UV ink but still allows the UV ink to be mixed with non-cured UV ink deposited later thereon. In addition, the temporarily cured UV ink has less uneven, i.e. is leveled. After that, the ultraviolet curable inks are irradiated with the ultraviolet light of the second light quantity by the second ultraviolet light irradiation step. According to the embodiment, the superposed ultraviolet curable inks are finally cured in the mixed state, thereby improving the printing strength in case of printing by the multipass method.

A head of the embodiment of the present invention is a head used in an ultraviolet curing inkjet printer of a type in which a same line on a recording medium is scanned a plurality of times by a head ejecting ultraviolet curable inks and is characterized by including a first ejecting means for ejecting ultraviolet curable inks to a plurality of lines on the recording medium; a first ultraviolet light irradiation means which is disposed posterior to the first ejecting means in a first direction as the scanning direction and emits ultraviolet light of a first light quantity for temporarily curing the ultraviolet curable inks ejected from the first ejecting means; and a second ultraviolet light irradiation means which is disposed anterior to the first ejecting means in a second direction, which is perpendicular to the first direction and is the moving direction of the recording medium relative to the head, and emits ultraviolet light of a second light quantity for finally curing the ultraviolet curable inks temporarily cured by the first ultraviolet light irradiation means.

In the head of the embodiment of the present invention, the first ejecting means ejects ultraviolet curable inks on a plurality of lines so that ultraviolet curable inks are ejected on a same line a plurality of times from the first ejecting means and are superposed on each other so as to form a color image. Since the second ultraviolet light irradiation means is disposed anterior to the first ejecting means in the second direction, the scanned lines are not irradiated with ultraviolet light of the second light quantity from the second ultraviolet light irradiation means while the scanned lines are irradiated with ultraviolet light of the first light quantity from the first ultraviolet light irradiation means until all ejections of ultraviolet curable inks by the first ejecting means are completed. Accordingly, the ultraviolet curable inks superposed by the first ejecting means are in temporarily cured state. That is, the lower layer ultraviolet curable ink is not finally cured and is thus allowed to be mixed with the upper layer ultraviolet curable ink. In other words, the temporarily cured ultraviolet curable ink has a viscosity which is higher than that of a non-cured UV ink but still allows the UV ink to be mixed with non-cured UV ink deposited later thereon. In addition, the temporarily cured UV ink has less uneven, i.e. is leveled. After that, the ultraviolet light of the second light quantity is emitted from the second ultraviolet light irradiation means to the scanned line on which all scans by the first ejecting means are completed. According to the embodiment of the present invention, the superposed ultraviolet curable inks are finally cured in the mixed state, thereby improving the printing strength in case of printing by the multipass method.

Embodiments of the present invention advantageously achieve improvements of printing strength in case of printing of a multipass method.

It should be noted that the exemplary embodiments depicted and described herein set forth the preferred embodiments of the present invention, and are not meant to limit the scope of the claims hereto in any way. Numerous modifications and variations of the present invention are possible in light of the above teachings. It is therefore to be understood that, within the scope of the appended claims, the invention may be practiced otherwise than as specifically described herein.

What is claimed is:

1. An ultraviolet curing inkjet printer comprising:

first ejecting means for ejecting ultraviolet curable inks to a plurality of lines on a recording medium;

first ultraviolet light irradiation means for emitting ultraviolet light of a first light quantity for temporarily curing the ultraviolet curable inks ejected from said first ejecting means, said first ultraviolet light irradiation means being, disposed posterior to said first ejecting means in a first direction as a scanning direction;

second ultraviolet light irradiation means for emitting ultraviolet light of a second light quantity for finally curing the ultraviolet curable inks temporarily cured by said first ultraviolet light irradiation means, said second ultraviolet light irradiation means being disposed anterior to said first ejecting means in a second direction, which is perpendicular to said first direction and is a moving direction of the recording medium relative to said first ejecting means; and second ejecting means for ejecting ultraviolet curable inks to the recording medium, said second ejecting means being disposed anterior to said first ejecting means in said second direction and being disposed anterior to said second ultraviolet light irradiation means in said first direction or posterior to said second ultraviolet light irradiation means in said second direction.

2. An ultraviolet curing inkjet printer comprising:

a first ejecting device configured to eject ultraviolet curable inks to a plurality of lines on the recording medium;

a first ultraviolet light irradiation device configured to emit ultraviolet light of a first light quantity for temporarily curing the ultraviolet curable inks ejected from said first ejecting device, said first ultraviolet light irradiation device being disposed posterior to said first ejecting device in a first direction as a scanning direction;

a second ultraviolet light irradiation device configured to emit ultraviolet light of a second light quantity for finally curing the ultraviolet curable inks temporarily cured by said first ultraviolet light irradiation device, said second ultraviolet light irradiation device being disposed anterior to said first ejecting device in a second direction, which is perpendicular to said first direction and is a moving direction of the recording medium relative to said first ejecting device; and a second ejecting device configured to eject ultraviolet curable inks to the recording medium, said second ejecting device being disposed anterior to said first ejecting device in said second direction and being disposed anterior to said second ultraviolet light irradiation device in said first direction or posterior to said second ultraviolet light irradiation device in said second direction.

3. The ultraviolet curing inkjet printer as claimed in claim 2, wherein said first ejecting device is configured to eject the ultraviolet curable inks to form an image, and said second ejecting device is configured to eject the ultraviolet curable ink to form a ground color layer.

4. A printing method for an ultraviolet curing inkjet printer, said printing method comprising:

a first ejecting step of ejecting ultraviolet curable inks to a plurality of lines on a recording medium;

a first ultraviolet light irradiation step of emitting ultraviolet light of a first light quantity for temporarily curing the ultraviolet curable inks ejected in said first ejecting step; and a second ultraviolet light irradiation step of emitting ultraviolet light of a second light quantity for finally curing the ultraviolet curable inks temporarily cured in said first ultraviolet light irradiation step after all scans for a same line by said first ejecting step are completed, wherein said first ultraviolet light irradiation step is performed at an area disposed posterior to an area where said first ejecting step is performed in a first direction as a scanning direction, wherein said second ultraviolet light irradiation step is performed at an area disposed anterior to said first ejecting step in a second direction, which is perpendicular to said first direction and is a moving direction of the recording medium relative to said head, and further comprising a second ejecting step of ejecting ultraviolet curable inks to the recording medium, wherein said second ejecting step is performed at an area disposed anterior to the area where said first ejecting step is performed in said second direction, and wherein the area where said second ejecting step is performed is disposed anterior to the area where said second ultraviolet light irradiation step is performed in said first direction or posterior to the area where said second ultraviolet light irradiation step is performed in said second direction.

5. The printing method as claimed in claim 4, wherein said first ejecting step includes ejecting the ultraviolet curable inks to form an image, and said second ejecting step includes ejecting the ultraviolet curable ink to form a ground color layer.

6. A head used in an ultraviolet curing inkjet printer, comprising:

first ejecting means for ejecting ultraviolet curable inks to a plurality of lines on a recording medium;

first ultraviolet light irradiation means for emitting ultraviolet light of a first light quantity for temporarily curing the ultraviolet curable inks ejected from said first ejecting means, said first ultraviolet light irradiation means being disposed posterior to said first ejecting means in a first direction as a scanning direction;

second ultraviolet light irradiation means for emitting ultraviolet light of a second light quantity for finally curing the ultraviolet curable inks temporarily cured by said first ultraviolet light irradiation means, said second ultraviolet light irradiation means being disposed anterior to said first ejecting means in a second direction, which is perpendicular to said first direction and is a moving direction of the recording medium relative to said head; and second ejecting means for ejecting ultraviolet curable inks to the recording medium, said second ejecting means being disposed anterior to said first ejecting means in said second direction and being disposed anterior to said second ultraviolet light irradiation means in said first direction or posterior to said second ultraviolet light irradiation means in said second direction.

7. A head used in an ultraviolet curing inkjet printer, comprising:

a first ejecting device configured to eject ultraviolet curable inks to a plurality of lines on a recording medium;

a first ultraviolet light irradiation device configured to emit ultraviolet light of a first light quantity for temporarily curing the ultraviolet curable inks ejected from said first ejecting device, said first ultraviolet light irradiation device being disposed posterior to said first ejecting device in a first direction as a scanning direction;

a second ultraviolet light irradiation device configured to emit ultraviolet light of a second light quantity for finally curing the ultraviolet curable inks temporarily cured by said first ultraviolet light irradiation device, said second ultraviolet light irradiation device being disposed anterior to said first ejecting device in a second direction, which is perpendicular to said first direction and is a moving direction of the recording medium relative to said head; and a second ejecting device configured to eject ultraviolet curable inks to the recording medium, said second ejecting device being disposed anterior to said first ejecting device in said second direction and being disposed anterior to said second ultraviolet light irradiation device in said first direction or posterior to said second ultraviolet light irradiation device in said second direction.

8. The head as claimed in claim 7, wherein said first ejecting device is configured to eject the ultraviolet curable inks to form an image, and said second ejecting device is configured to eject the ultraviolet curable ink to form a ground color layer.

* * * * *